US005488814A

United States Patent [19]

Rankin et al.

[11] Patent Number: 5,488,814

[45] Date of Patent: Feb. 6, 1996

[54] STRETCH WRAPPING OF ROLL PRODUCTS

[75] Inventors: Bill Rankin; Jim Lancaster, both of Louisville, Ky.

[73] Assignee: Lantech, Inc., Louisville, Ky.

[21] Appl. No.: 194,593

[22] Filed: Feb. 10, 1994

[51] Int. Cl.[6] ..... B65B 13/02; B65B 53/00

[52] U.S. Cl. ..... 53/399; 53/441; 53/556; 53/587

[58] Field of Search ..... 53/552, 465, 556, 53/587, 214, 215, 211, 399

[56] References Cited

U.S. PATENT DOCUMENTS

| | | | |
|---|---|---|---|
| 3,716,964 | 2/1973 | Reynolds et al. | 53/211 X |
| 4,333,301 | 6/1982 | Koutonen et al. | 53/587 |
| 4,485,612 | 12/1984 | Piesen et al. | 53/211 X |
| 4,553,374 | 11/1985 | Lancaster et al. | 53/465 |
| 4,726,172 | 2/1988 | Pienta | 53/587 X |
| 4,761,934 | 8/1988 | Lancaster | 53/399 |
| 4,858,415 | 8/1989 | Hake | 53/438 |
| 5,161,349 | 11/1992 | Lancaster et al. | 53/399 |

FOREIGN PATENT DOCUMENTS

| | | | |
|---|---|---|---|
| 3025180 | 1/1982 | Germany | 53/222 |

*Primary Examiner*—Linda Johnson

*Attorney, Agent, or Firm*—Finnegan, Henderson, Farabow, Garrett & Dunner

[57] ABSTRACT

A roll product is wrapped with a sheet of stretch wrap packaging material dispensed from a stretch wrap dispenser. A portion of the sheet is positioned between a clamp and the stretch wrap dispenser so that the portion of the sheet is across a load path between the load and a roller for rotating the load. The load is transported along the load path and placed in driving contact with the roller. The load is rotated by driving the load with a roller. The clamp is moved from a first location to a second location where the sheet is wrapped around the load and secured in place by another portion of the sheet.

31 Claims, 11 Drawing Sheets

STRETCH WRAPPING OF ROLL PRODUCTS

BACKGROUND OF THE INVENTION

The invention relates to stretch wrapping a load, particularly a load which is a roll product such as a generally circular roll of paper, fabric, or carpet. Stretch wrapping apparatus have been used to wrap a load with a sheet of stretch wrap packaging materials such as a film web. Examples of stretch wrapping apparatus are shown in U.S. Pat. Nos. 4,553,374 and 4,858,415 which are incorporated herein by reference.

Roll products have been wrapped by orienting the roll product so that its principal axis is generally vertical, and rotating it about that vertical axis while stretch wrapping a web around the circumference of the roll product.

Roll products also have been wrapped in a cocoon style by orienting the roll product on a horizontal axis, and rotating it about that horizontal axis by trundle rollers while stretch wrapping a web around its circumference and longitudinally about its ends.

Roll products also have been wrapped by passing the roll product through a ring on which a stretch wrap dispenser is mounted, while rotating the ring and stretch wrapping a web around the circumference of the roll product.

Roll products also have been wrapped by orienting the roll product so that its principal axis is generally horizontal and so that it rests on horizontal trundle rollers, manually or automatically attaching the leading end of the stretch wrap packaging web to the roll product with tape or glue, and rotating the roll product with the trundle rollers to stretch wrap the attached web around the circumference of the roll product.

While these arrangements and efforts have been successful, it is desirable to stretch wrap a roll product more efficiently and effectively while minimizing any waste or damage to the roll product.

SUMMARY OF THE INVENTION

According to the invention, an arrangement is provided for stretch wrapping a roll product load with a sheet of stretch wrap packaging material dispensed from a stretch wrap dispenser. A portion of the sheet is positioned between a clamp and the stretch wrap dispenser so that the portion of the sheet is across a load path between the load and a roller for rotating a load relative to the stretch wrap dispenser. The load is transported along the load path and placed in driving contact with the roller. The load is rotated about a generally horizontal axis with at least one roller, and the clamp is moved between a first location and a second location where the sheet is wrapped around the load and secured in place by another portion of the sheet.

BRIEF DESCRIPTION OF THE DRAWINGS

The accompanying drawings, which are incorporated in and constitute part of the specification, illustrate a presently preferred embodiment of the invention and, together with a general description given above and the detailed description of the preferred embodiments given below, serve to explain the principles of the invention.

DETAILED DESCRIPTION OF THE PREFERRED EMBODIMENTS

Figure 1:
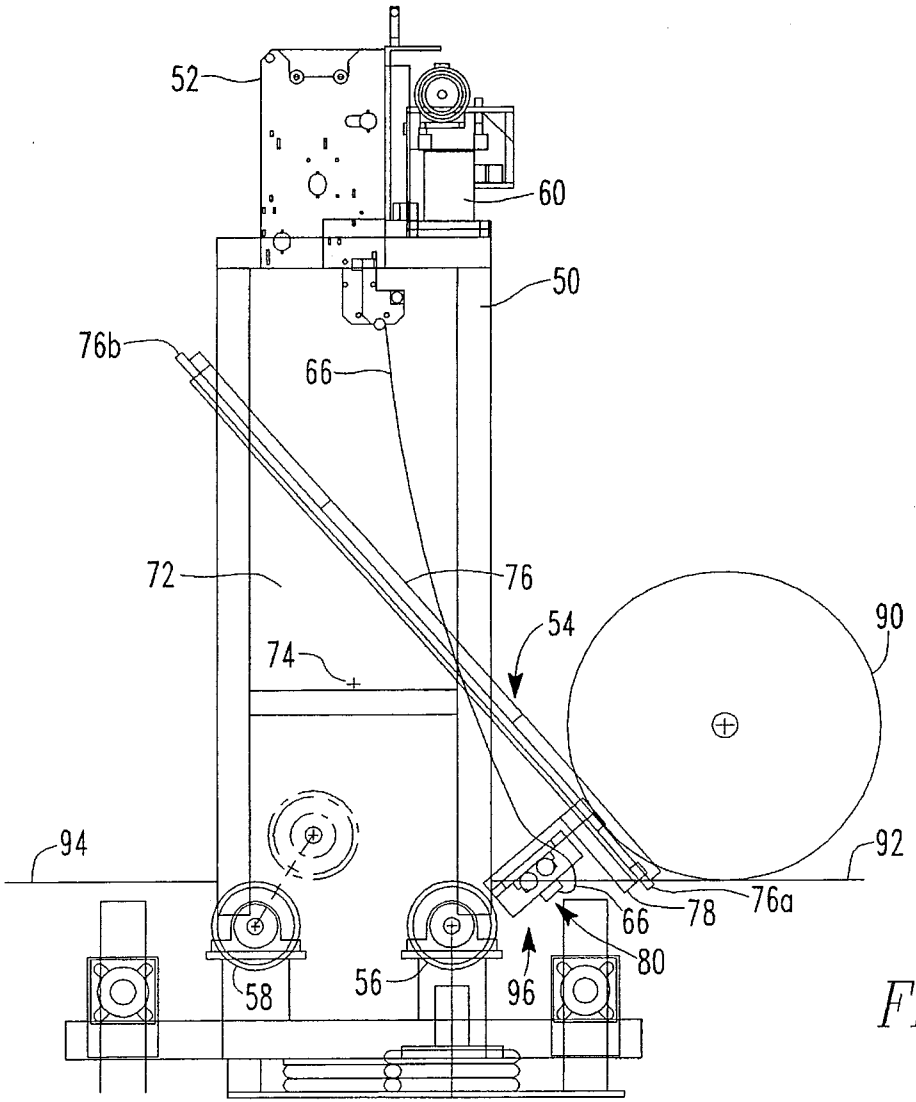
FIGS. 1–8 are sequential end views of a stretch wrapping process and apparatus that incorporate the teachings of the present invention.
Figure 2:
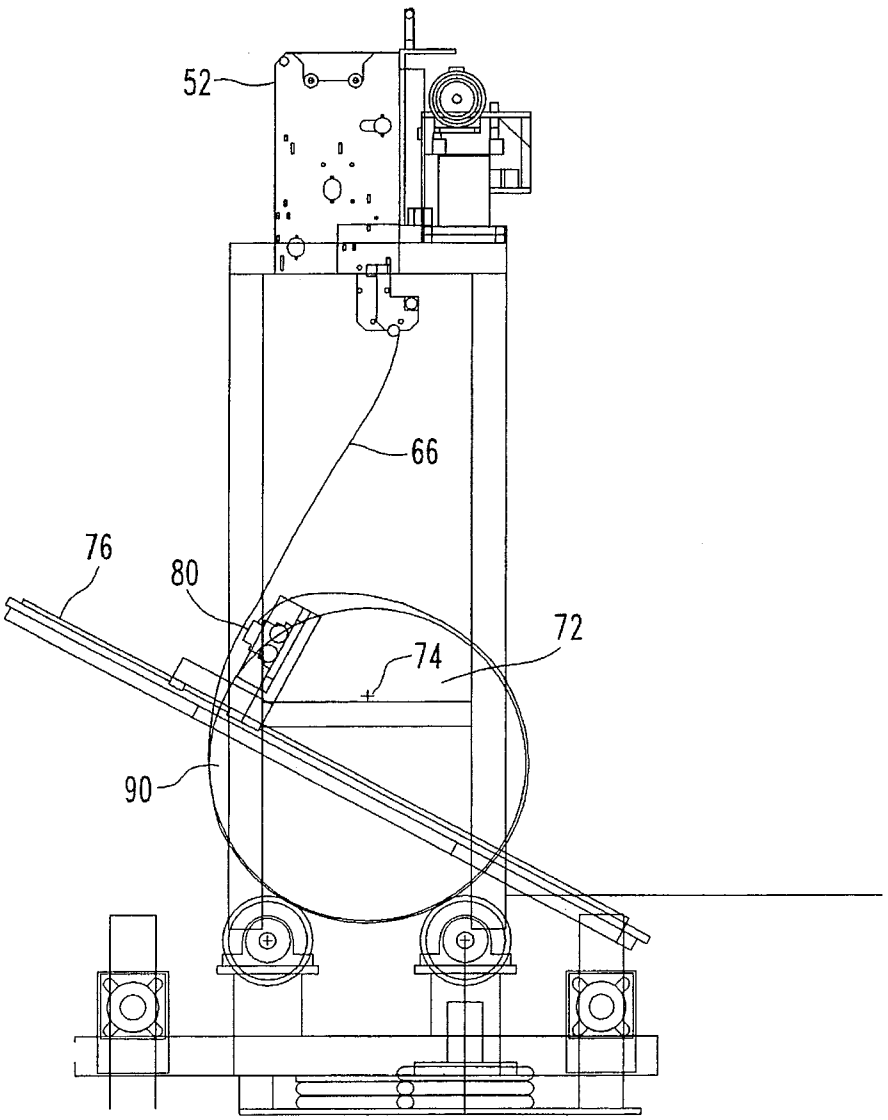

A process and apparatus for stretch wrapping a roll product is shown in FIGS. 1–8. The apparatus includes a frame 50, a stretch wrap dispenser 52, a clamp assembly 54, rollers 56 and 58, and a control system 60.

Figure 9:
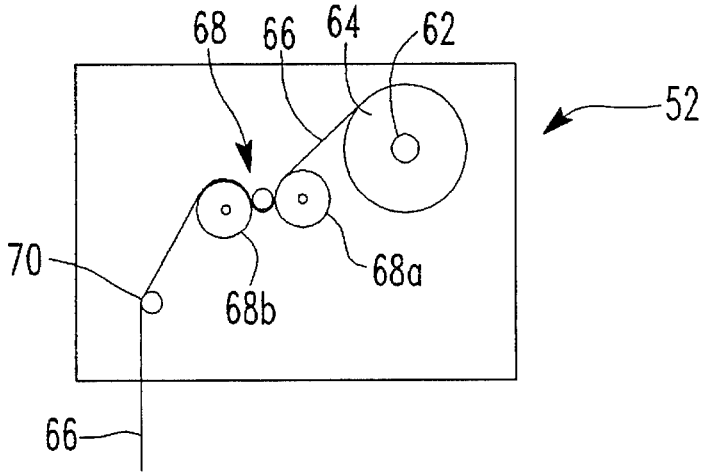
FIG. 9 is an end view of a dispenser shown in FIG. 1.
Figure 11:
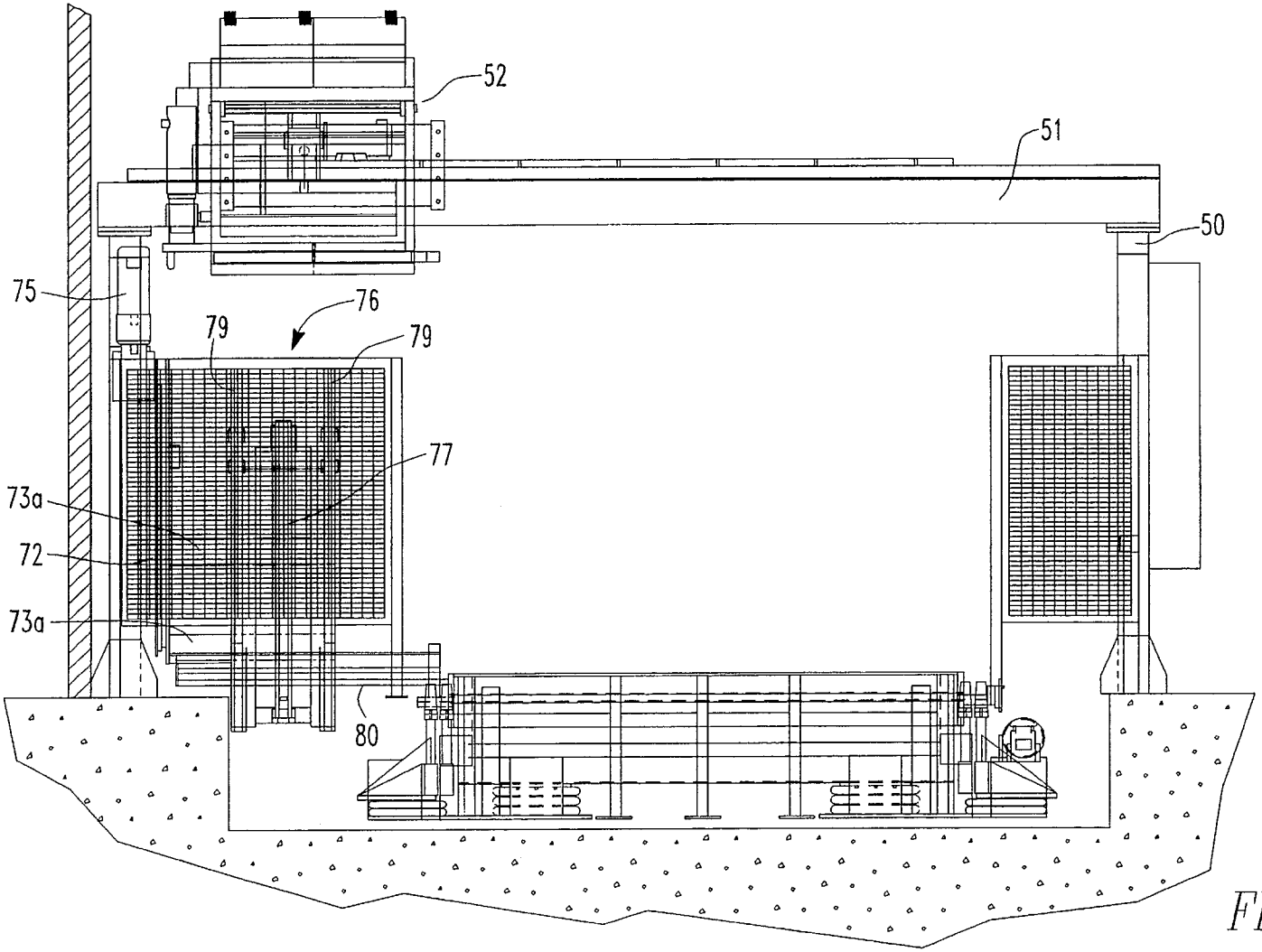
FIG. 11 is a side view of the apparatus shown in FIG. 1.

The stretch wrap dispenser 52 may be a conventional stretch wrap dispenser. Suitable dispensers are shown in U.S. Pat. No. 5,161,349, which is incorporated herein by reference. As shown in FIG. 9, stretch wrap dispenser 52 may include a support 62 for a roll 64 of stretch wrap packaging material such as a film web 66. Dispenser 52 also may include a prestretch device 68 having a downstream roller **68*b* which is geared to an upstream roller 68*a* to rotate faster than upstream roller 68*a*. Another roller 70 may assist in dispensing film web 66. As shown in FIG. 11, dispenser 52 is mounted on top of beam 51 of frame 50 to be controllably driven along beam 51 by an electric motor drive through a rack and pinion engagement with beam 51**.

Figure 12:
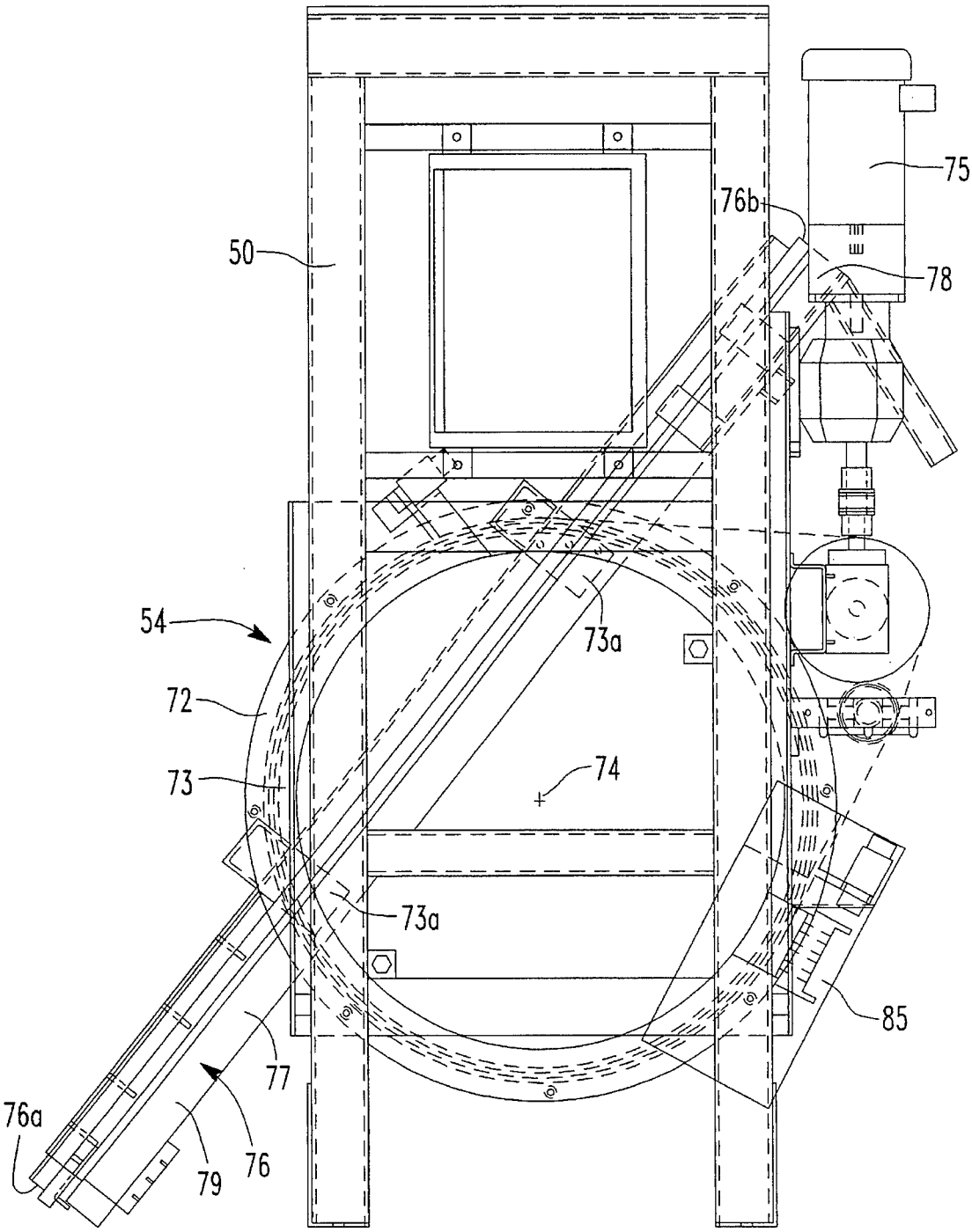
FIG. 12 is an end view of a clamp assembly shown in FIG. 1.

As shown in FIG. 12, clamp assembly 54 preferably includes a rotatable mounting such as a slew ring having an outer race 72, which is mounted on frame 50, and an inner race 73, which is mounted for rotation about horizontal axis 74. Motor 75 drives inner race 73 through a mechanical drive such as a reducer, coupling, 90° gear box and chain and sprocket drive. Other drive and mounting arrangements also may be used as alternatives. It is also possible to alternatively drive the interior race 73 by a direct or indirect engagement with another drive mechanism, including the surface of the load.

As shown in FIGS. 11 and 12, a traverse arm 76 is mounted on the supports **73*a* which extend axially from inner race 73 and rotate with inner race 73 about axis 74. Counterweight 85 is mounted on inner race 73 to counter balance traverse arm 76. Carriage 78 rides along tracks 79 on traverse arm 76 and is linearly translatable from one end 76*a* to the other end 76*b* of traverse arm 76 by a driving mechanism such as a rodless air cylinder and air brake 77 which is mounted on traverse arm 76. A clamp 80 is mounted on carriage 78**.

Figure 10:
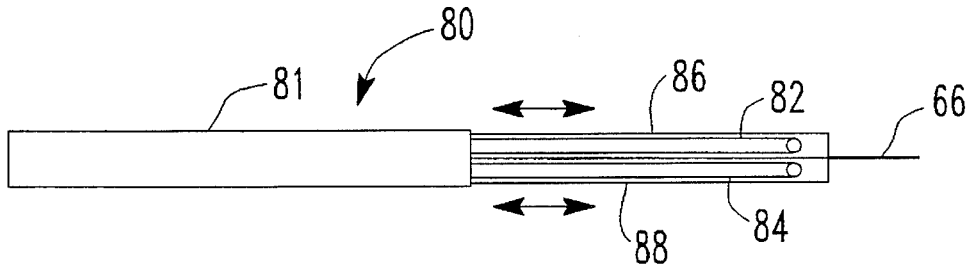
FIG. 10 is a side view of a clamp shown in FIG. 1.

A suitable clamp with a cutter is shown in FIG. 10 and described in more detail in U.S. Pat. No. 4,761,934, which is incorporated herein by reference. As shown in FIG. 10, belts 82 and 84 of respective arms 86 and 88 clamp film web 66 between them as at least one of arms 86 and 88 are extended from housing 81, and release film web 66 when arms 86 and 88 are retracted into housing 81 by a linear actuator within housing 81. Alternatively, the clamp and cutter may include other mechanisms for holding and cutting the film web.

As shown in FIG. 1, rollers 56 and 58 are steel cradle or trundle rollers mounted on frame 50. The rollers each rotate about respective central horizontal axes. Roller 58 is mounted in an arm which can be pivoted about an axis between a raised position, shown in phantom lines in FIG. 1, for receiving a load, and a lowered position, shown in solid lines, for wrapping a load 90. A solenoid may be used to actuate and deactuate an air bag or air cylinder and thereby pivot roller 58 between the raised and lowered positions.

Either or both of rollers 56 and 58 may be driven rollers. Other embodiments are also within the scope of this invention. An infeed surface 92 and an outfeed surface 94 are used to support load 90 and allow it to roll into and out of the wrapping position where it is supported by roller 56 and 58. Infeed surface 92 and outfeed surface 94 can include, for example, declining ramps which assist in moving load 90 into and out of the wrapping position.

The control system 60 can be any of a number of alternatives including microcontrollers or relay logic. It may include a CPU such as an Allen-Bradley 5/11 PLC which may control the operation in the following manner.

FIGS. 1–8 show a sequence of operation for the preferred embodiment in which the wrapping sequence is performed automatically. As shown in FIG. 1, the leading end of film web 66 is clamped between arms 86 and 88 of clamp 80. Belt members 82 and 84 of arms 86 and 88 engage the sheet substantially across its width.

As shown, a portion of sheet 66 is positioned between clamp 80 and dispenser 52 so that a portion of sheet 66 is across a load path between load 90 and rollers 56 and 58 for rotating the load. When the clamp 80 is in this first position, arms 86 and 88 are positioned below the level of infeed surface 92. While roller 58 is in the raised position, shown in phantom, load 90 is transported along the load path by rolling it down infeed surface 92 until it is positioned against cradle roller 58. In response to a sensor, such as a photocell, cradle roller 58 is then lowered to its wrapping position, shown in solid lines, so that the load 90 rests in the cradle defined by cradle rollers 56 and 58.

In rolling load 90 into this position, it rolls over a gap between infeed surface 92 and roller 56 through which sheet 66 extends. In rolling over that gap to the cradle position, load 90 rolls over sheet 66 so that sheet 66 is positioned between load 90 and rollers 56 and 58. During this step, the dispenser dispenses the film under low tension. The load can be rolled into position by hand or machine. Other mechanisms, like a fork lift, can be used to put the load into position to be wrapped.

Clamp 80 moves linearly along traverse arm 76 to position the clamped part of the film close to the load surface. This is done with a sensor arrangement such as a pair of photocells which allows the clamp to search and stop near the load surface. Clamp 80 may be positioned and locked in place on traverse arm 76 with an air cylinder and air brake.

An ultrasonic sensor may be used to sense the height of the load and determine its diameter. Based on this information, roller 58 can then be driven to rotate the load at a desired velocity such as an angular velocity which matches the angular velocity of the clamp 80 and traverse arm 76.

Roller 58 is driven by a motor and reducer which is mounted on its pivot arm to rotate load 90 and sheet 66 between load 90 and rollers 56 and 58. As this occurs, sheet 66 is drawn from dispenser 52 and the sheet is stretched at the normal wrapping tension and clamp 80 is rotated from the first location shown in FIG. 1 to the second location shown in FIG. 2 by rotating clamp frame 72 about axis 74. At the second location, which is determined by a timer in the controller or limit switch and shown, for example, in FIG. 2, sheet 66 is wrapped around the circumference of load 90 and the leading part of the sheet, which was pulled by clamp 80, is secured in place by another portion of the sheet which comes to overlay the leading part.

Arms 86 and 88 of clamp 80 are then retracted out of the film path and release the film. The leading end of the film which was previously clamped by clamp 80 is now held in place by the overwrap of sheet 66. The bottom arm of clamp 80 may be retracted first, and the top arm of clamp 80 may then be retracted in response to a reed switch indicating that the bottom arm is retracted.

Clamp 80 may release the film after wrapping it around the load but before it is overwrapped. If this is done, it is preferable that the film is released after the film and clamp 80 have reached the uppermost point of the load or an appropriate position so the film stays in place and does not slide back before being secured in place by another portion of the sheet.

After clamp 80 releases the film, roller 58 may accelerate to speed the wrapping of the load. If the load is being spirally wrapped, dispenser 52 moves along top beam 51 of frame 50 at a speed which may be related to the angular speed of the load to obtain the desired overlap of the film. At the ends of the load, the sheet may be overwrapped a number of times by having the dispenser 52 dwell in that position. The various wrap operations can be programmed into the CPU as desired for the particular load to be wrapped.

Figure 3:
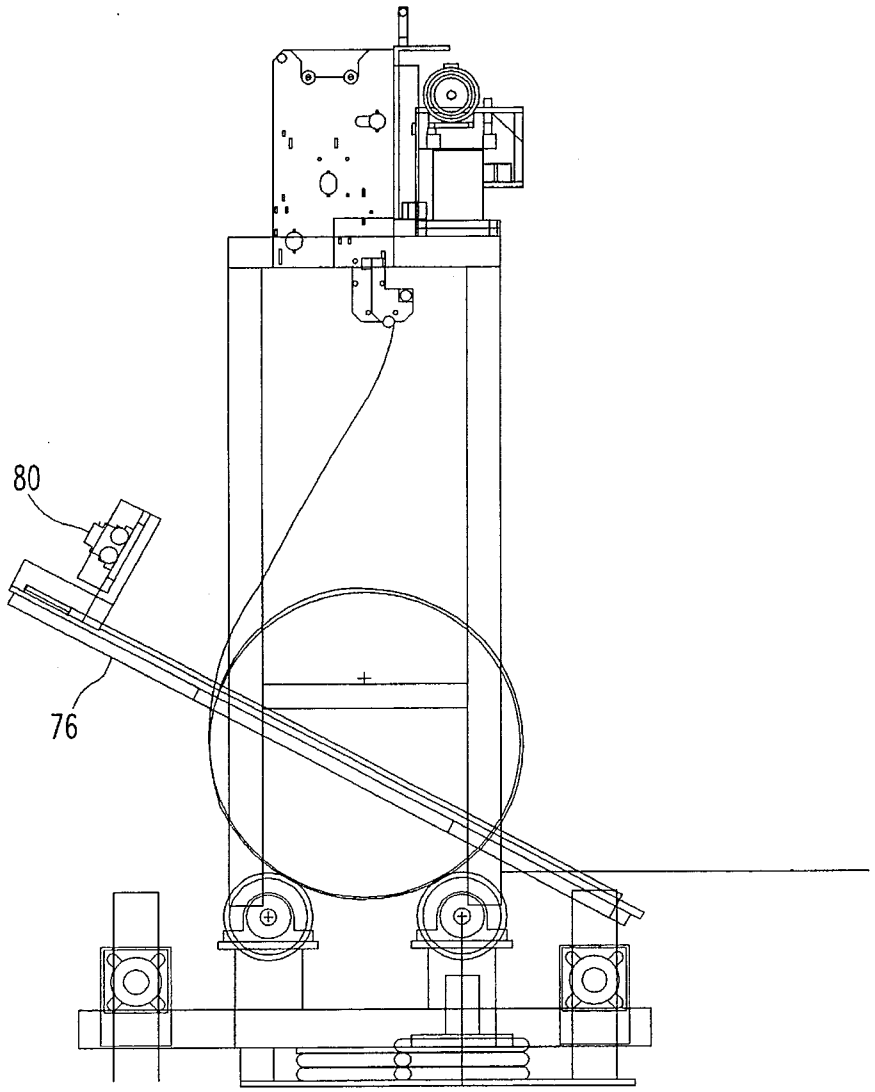

As shown in FIG. 3, clamp 80 may be linearly moved to the position shown on traverse arm 76 and ready to rotate back to the first location shown in FIG. 1. As shown in the sequence between FIGS. 3 and 4, the clamp 80 is returned to the first location by rotating clamp frame 72 about axis 74 preferably during any additional wrapping of the load which is desired.

Figure 4:
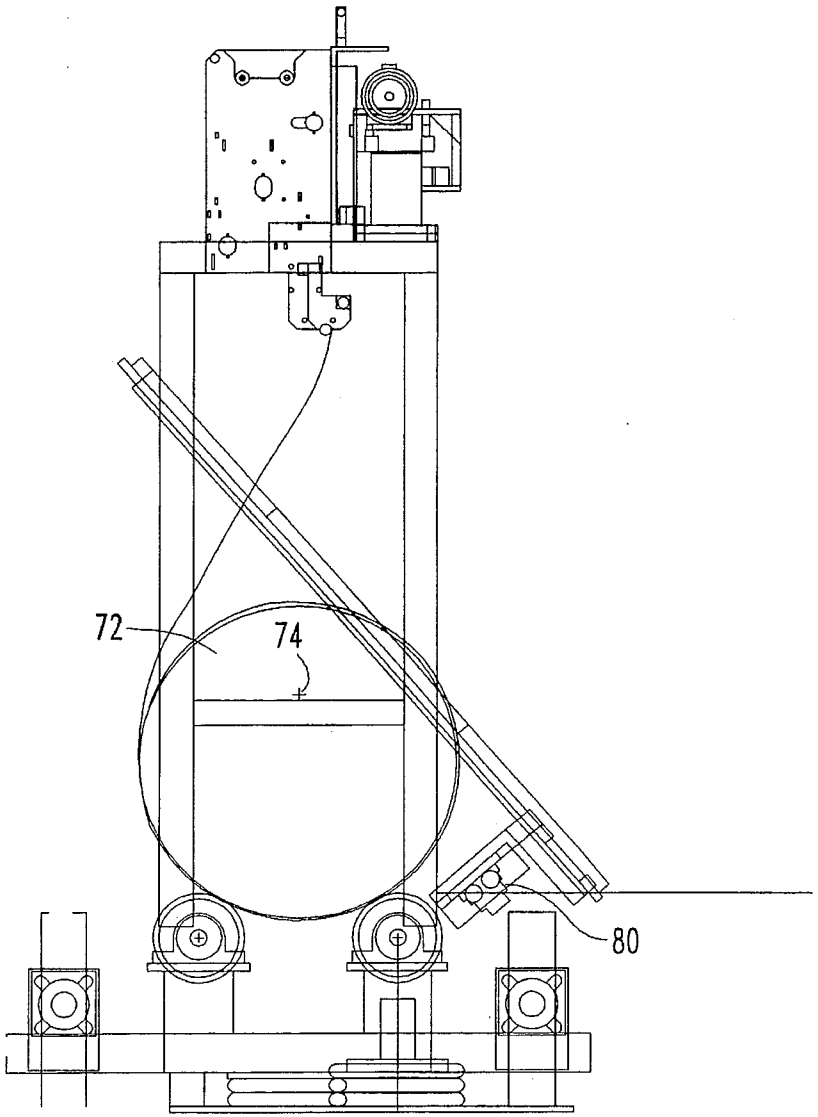
Figure 5:
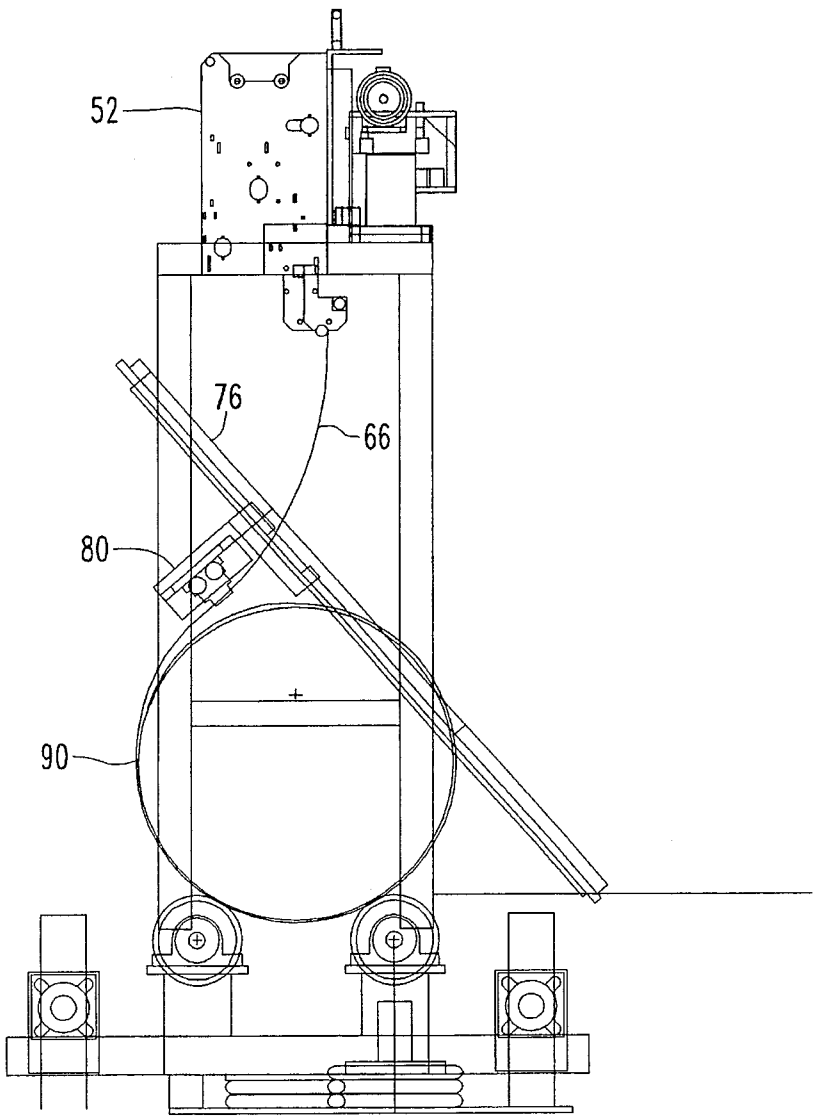

During the sequence between the positions shown in FIGS. 4 and 5, the clamp 80 has moved from the first location back to the second location by linearly traveling along traverse arm 76. Clamp 80 seeks the surface of the load. As it reaches the second location, one of its arms extend to engage the film and the other arm then extends to clamp part of the sheet 66 extending between the load 90 and dispenser 52, cutting the sheet between the arms 86 and 88 of clamp 80 and the load 90.

Figure 6:
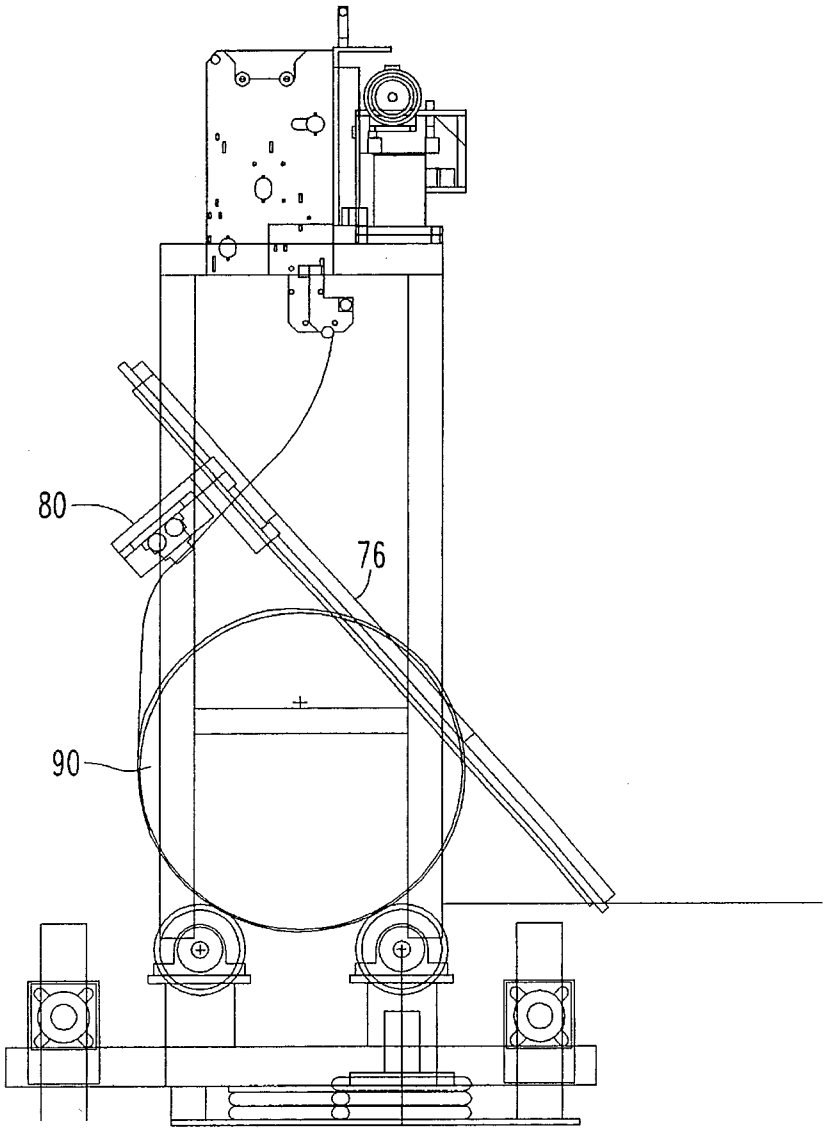
Figure 7:
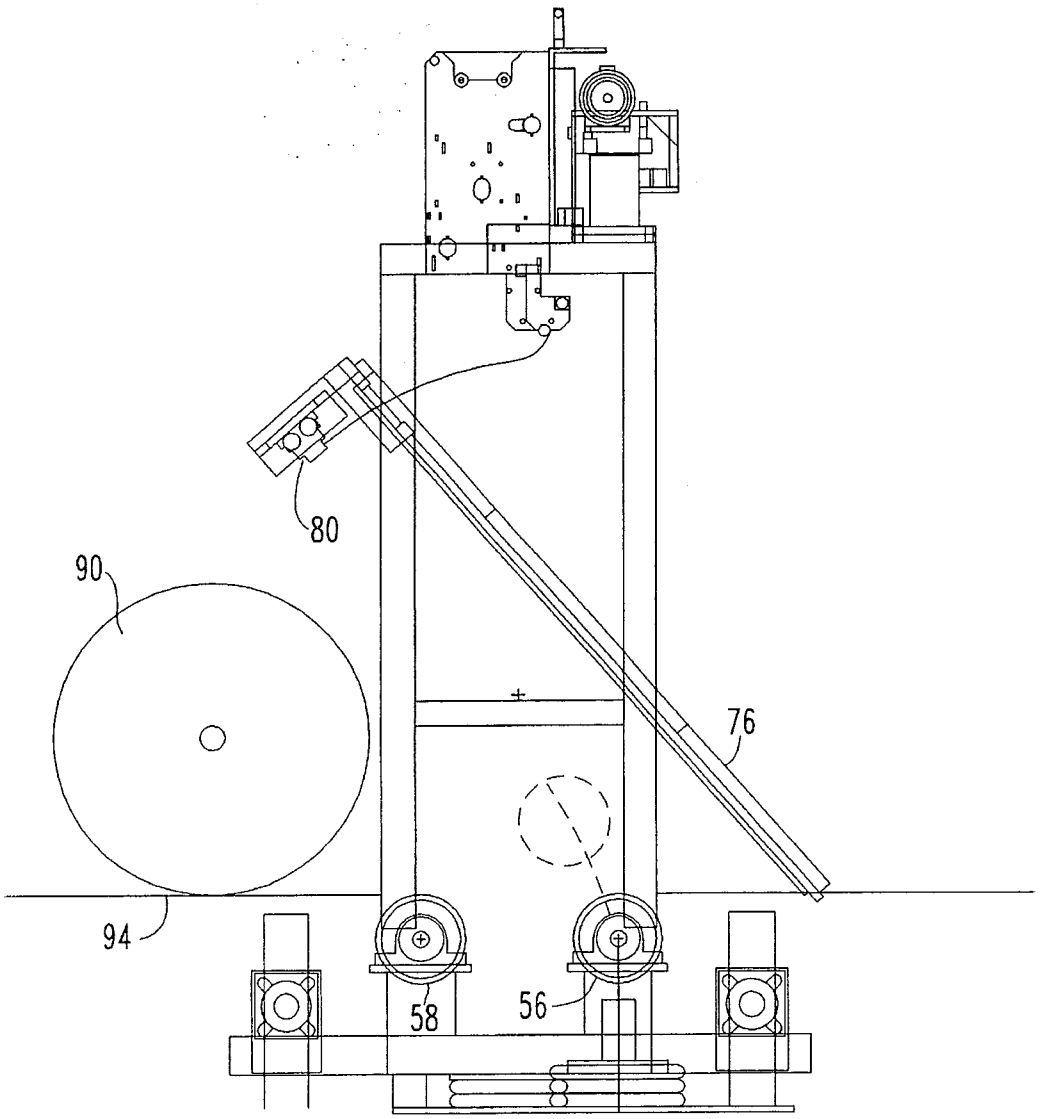

As shown in FIG. 6, clamp 80 is further extended along traverse arm 76 to provide clearance between the extended clamp 80 and the top of load 90 so that load 90 may be ejected from the wrapping cradle as shown in FIG. 7. Alternatively, arms 86 and 88 may be simultaneously retracted to provide clearance for the load to exit the wrapping area.

As shown in FIG. 7, roller 56 pivots between the wrapping position, shown in solid lines, to the unloading position, is shown in phantom. When roller 56 is moved to the unloading position, roll 90 is pushed out of the wrapping position and onto outfeed surface 94. The mechanism for pivoting roller 56 can be the same as that for pivoting roller 58.

Figure 8:
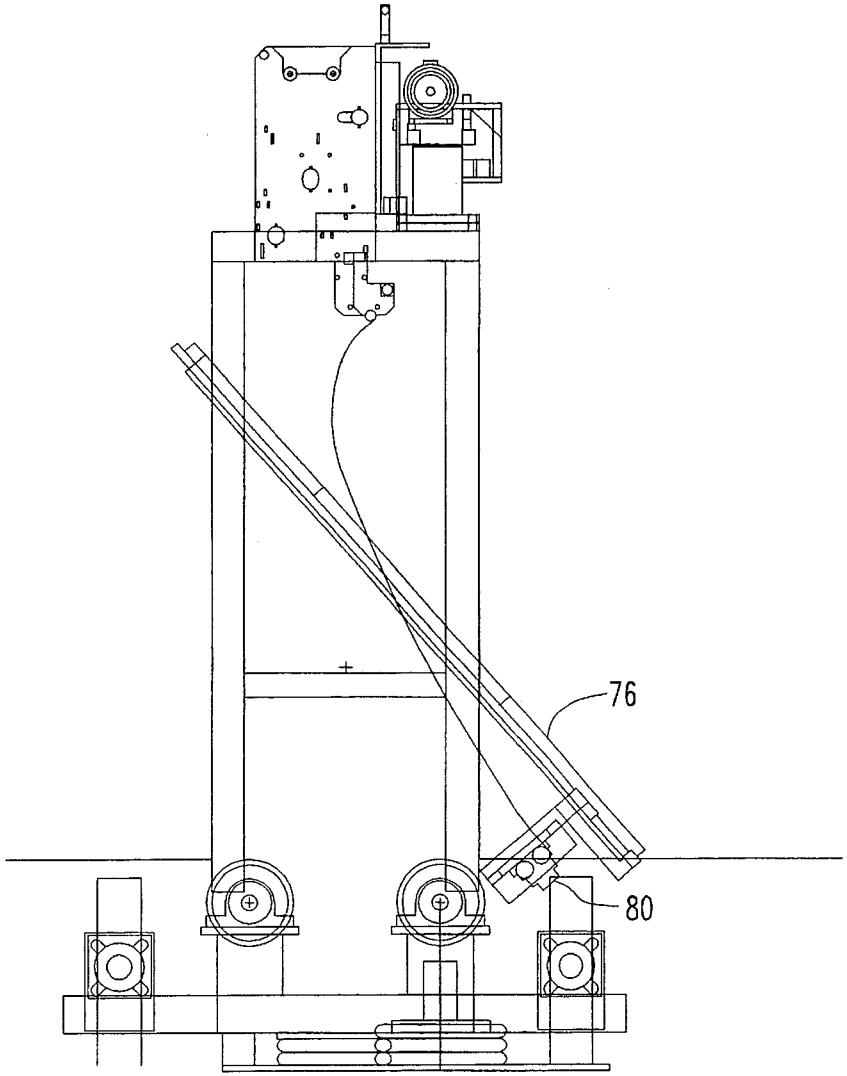

In response to a sensor, which indicated that the load is clear of the wrapping area, roller 56 is then returned to the wrapping position, and clamp 80 is moved between the positions shown FIGS. 7 and 8 by translating clamp 80 along traverse arm 76 from the second location to the first location, where it is ready to wrap a new load.

Additional advantages and modifications will readily occur to those skilled in the art. The invention in its broader aspects is, therefore, not limited to these specific details, representative apparatus and illustrative examples shown and described. Accordingly, departures may be made from such details without departing from the spirit or scope of the general inventive concept as defined by the appended claims and their equivalents.

What is claimed is:

1. A process for stretch wrapping a roll product load with a sheet of stretch wrap packaging material dispensed from a stretch wrap dispenser comprising:

clamping a leading end of the sheet with a clamp, the clamp being positioned in a first location so that a portion of the sheet between the clamp and the dispenser extends across a load path between the load and at least one roller for rotating the load;

transporting the load along the load path, contacting a portion of the sheet extending between the dispenser and the clamp, and placing the load and roller in driving contact with each other via the sheet;

rotating the load about a generally horizontal axis by driving the load with the roller; and moving the clamp and the clamped leading end of the sheet from the first location to a second location where the sheet is wrapped around the load and the leading end of the sheet is secured in place by another portion of the sheet.

2. The process of claim 1, wherein the moving step includes rotating the clamp about a portion of the load from the first location to the second location.

3. The process of claim 2, wherein the clamp and load are rotated at the same angular velocity.

4. The process of claim 2 further including the steps of subsequently releasing the sheet from the clamp, rotating the clamp back around from the second location to the first location, translating the clamp from the first location to the second location, clamping a part of the sheet extending between the load and dispenser, cutting the sheet between the clamp and the load and translating the clamp and the clamped part of the sheet to the first position.

5. The process of claim 4, wherein the placing step includes rolling the load along the load path to a position where the load rests against the roller.

6. The process of claim 1, wherein the step of moving the clamp includes driving the clamp with the load.

7. An apparatus for stretch wrapping a roll product load with a sheet of stretch wrap packaging material dispensed from a stretch wrap dispenser comprising:

a stretch wrap dispenser for dispensing and stretching a sheet of stretch wrap packaging material;

at least one roller for supporting and rotating the load about a generally horizontal axis when the load is placed in driving contact with the roller via the sheet to wrap the sheet around the load; and a clamp assembly including a clamp, the clamp assembly for selectively clamping a part of the sheet with the clamp while the clamp assembly is disposed in a first location in which a portion of the sheet between the dispenser and the clamp assembly extends across a load path between the load and the roller, and for moving the clamp and clamped part of the sheet from the first location to a second location where the sheet is wrapped around the load and secured in place by another portion of the sheet.

8. The apparatus of claim 7, wherein the clamp assembly moves the clamped part of the sheet by rotating the clamped part of the sheet between the first location and the second location around a portion of the load.

9. The apparatus of claim 8, wherein the clamp assembly also translates the clamp between the first and second locations.

10. The apparatus of claim 7, wherein the clamp assembly moves the clamp between the first location and the second location through frictional engagement with the load.

11. The apparatus of claim 7, wherein the clamp assembly includes clamping members which engage substantially across the sheet.

12. The apparatus of claim 7, wherein the clamp assembly includes a linear track on which a clamp is mounted to translate along the linear track, and a rotatable frame on which the track is mounted.

13. The process of claim 1, wherein the step of moving the clamp and the clamped leading end of the sheet is performed during the rotating step.

14. The process of claim 1, wherein the first location is disposed below the load path.

15. The apparatus of claim 7, wherein the clamp assembly moves the clamp and clamped part of the sheet while the roller rotates the load.

16. The apparatus of claim 7, wherein the first location is disposed below the load path.

17. A process for stretch wrapping a roll product load with a sheet of stretch wrap packaging material dispensed from a stretch wrap dispenser comprising:

clamping a leading end of the sheet with a clamp;

moving the clamp to a first location so that a portion of the sheet between the clamp and the dispenser extends across a load path between the load and at least one roller for rotating the load;

transporting the load along the load path to contact the extending portion of the sheet and place the load and roller in driving contact with each other via the sheet;

rotating the load about a generally horizontal axis by driving the load with the roller; and wrapping the sheet around the load.

18. The process of claim 17, further including the step of driving the clamp around the load to a second location to wrap the sheet around the load and secure the leading end of the sheet in place by another portion of the sheet.

19. The process of claim 17, wherein the first location is disposed below the load path.

20. The process of claim 18, wherein the step of driving the clamp is performed during the rotating step.

21. The process of claim 18, wherein the clamp is driven to the second location by a motor.

22. The process of claim 18, wherein the clamp is driven to the second location by the load.

23. The process of claim 18, wherein the clamp and load are rotated at the same angular velocity.

24. The process of claim 18, further including the steps of subsequently releasing the sheet from the clamp, rotating the clamp back around from the second location to the first location, translating the clamp from the first location to the second location, clamping a part of the sheet extending between the load and dispenser, cutting the sheet between the clamp and the load, and translating the clamp and the clamped part of the sheet to the first position.

25. An apparatus for stretch wrapping a roll product load with a sheet of stretch wrap packaging material dispensed from a stretch wrap dispenser comprising:

a stretch wrap dispenser for dispensing and stretching a sheet of stretch wrap packaging material;

at least one roller for supporting and rotating the load about a generally horizontal axis when the load is placed in driving contact with the roller via the sheet to wrap the sheet around the load; and a clamp assembly including a clamp, the clamp assembly for selectively clamping a leading end of the sheet with the clamp, and then moving the clamp and the clamped leading end to a first location in which a portion of the sheet between the dispenser and the clamp assembly extends across a load path between the load and the roller.

26. The apparatus of claim 25, wherein the clamp assembly moves the clamped leading end of the sheet from the first location to a second location where the sheet is wrapped around the load and secured in place by another portion of the sheet.

27. The apparatus of claim 25, wherein the first location is disposed below the load path.

28. The apparatus of claim 26, wherein the clamp assembly moves the clamp and clamped leading end of the sheet while the roller rotates the load.

29. The process of claim 26, wherein the clamp is moved to the second location by a motor.

30. The process of claim 26, wherein the clamp is moved to the second location by the load.

31. The process of claim 26, wherein the clamp and load are rotated at the same angular velocity.

* * * * *